US010577892B2

(12) United States Patent
Liess

(10) Patent No.: US 10,577,892 B2
(45) Date of Patent: Mar. 3, 2020

(54) POSITIONING TOOL

(71) Applicant: Weatherford Technology Holdings, LLC, Houston, TX (US)

(72) Inventor: Martin Liess, Seelze (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 246 days.

(21) Appl. No.: 15/667,504

(22) Filed: Aug. 2, 2017

(65) Prior Publication Data

US 2019/0040717 A1 Feb. 7, 2019

(51) Int. Cl.
*E21B 41/00* (2006.01)
*E21B 19/16* (2006.01)

(52) U.S. Cl.
CPC ..... *E21B 41/00* (2013.01); *E21B 19/16* (2013.01)

(58) Field of Classification Search
CPC ..... E21B 41/00; E21B 19/16
USPC ..... 408/187, 237
See application file for complete search history.

(56) References Cited

U.S. PATENT DOCUMENTS 4,548,544 A * 10/1985 Van Appledorn ..... B21J 13/10 198/750.11
4,843,945 A 7/1989 Dinsdale
6,142,041 A * 11/2000 Buck ..... E21B 19/165 81/57.16
6,318,214 B1 11/2001 Buck
7,001,065 B2 2/2006 Dishaw et al.
7,178,612 B2 2/2007 Belik
7,249,639 B2 * 7/2007 Belik ..... E21B 19/00 175/162
7,841,415 B2 11/2010 Winter
7,878,254 B2 2/2011 Abdollahi et al.
7,958,787 B2 6/2011 Hunter
9,068,406 B2 6/2015 Clasen et al.
9,212,778 B2 * 12/2015 Winter ..... F16M 13/022
2005/0047884 A1 3/2005 Belik
2008/0257607 A1 10/2008 Winter
2009/0159294 A1 6/2009 Abdollahi et al.
2011/0120730 A1 5/2011 Clasen et al.
2013/0271576 A1 10/2013 Ellis
2014/0233804 A1 8/2014 Gustavsson et al.

FOREIGN PATENT DOCUMENTS

CN 103422822 A 12/2013
CN 204283262 U 4/2015

OTHER PUBLICATIONS

United Kingdom Combined Search and Examination Report dated Nov. 23, 2018, for Application No. GB1810656.7.

* cited by examiner

*Primary Examiner* — Michael R Wills, III
(74) *Attorney, Agent, or Firm* — Patterson + Sheridan, LLP

(57) ABSTRACT

The present disclosure generally relates to an apparatus for positioning a tool at a well site. The positioning tool includes a retractable arm assembly having a tool adaptor and a leveling assembly. The leveling assembly includes a rigid leveling link pivotably coupled to a tool adaptor. The leveling assembly is coupled to the last two arms in the retractably assembly and uses the relative movement of the last two arms to level and stabilize the tool adaptor and the tool attached thereto.

21 Claims, 11 Drawing Sheets

POSITIONING TOOL

BACKGROUND OF THE DISCLOSURE

Field of the Disclosure

The present disclosure generally relates to a positioning tool. Particularly, embodiments of the present disclosure relate to a positioning tool for handling wellbore tools, such as a tong.

Description of the Related Art

In oil and gas operation, wellbore tools, such as a tong, may be transferred and positioned to various locations. A positioning tool is usually used to move the wellbore tools. During a well operation, a work string, such as a drill string and a casing string, is deployed a wellbore. The work string may be made from multiple lengths of tubulars. Typically, a tong is used to connect tubulars to form the work string. The tong rotates a tubular to add the tubular to the top of the work string by a threaded connection. The tong provides the torque necessary to make-up (or break-out) the connection. At various times during the operation, the tong is moved between several locations at the well site, such as at well centerline, mouse holes, or a storage position. Due to the size and the weight of the tong and wellbore tools, the tong on a positioning tool may swing or tilt during tool transfer or tool operation.

Therefore, there is a need for a positioning tool with leveling or stabilizing capacity.

SUMMARY OF THE DISCLOSURE

The present disclosure generally relates to a positioning tool.

One embodiment of the present disclosure provides a positioning tool. The positioning tool includes a retractable arm assembly comprising a first arm, a second arm, wherein a first end of the first arm is pivotably coupled to the second arm and a second end of the first arm is pivotably coupled to a tool adaptor. The positioning tool further includes a leveling assembly comprising a leveling arm pivotably coupled to the first arm, a leveling link pivotably coupled to the tool adaptor and the leveling arm, wherein one or the leveling arm and the leveling link is connected to the second arm.

Another embodiment of the present disclosure provides a positioning tool. The positioning tool includes a drive arm movably connected to a frame member, an end arm in connection with the drive arm, wherein an end arm is pivotably coupled to a tool adaptor, and rotation of the drive arm extends or retracts the end arm moving the tool adaptor along a trajectory, a leveling arm pivotably coupled to the end arm, and a leveling link having an elongated body pivotably connected between the tool adaptor and the leveling arm.

Another embodiment provides a method for positioning a tool at a wellsite. The method includes supporting a tool on a tool adaptor at a first joint and a second joint, wherein the first joint pivotably connects the tool adaptor to an end arm in connection with a drive arm, and a second joint pivotably connects the tool adaptor to a rigid leveling link in connection with the end arm, and rotating the drive arm thereby causing the end arm to move the first joint along a first trajectory while leveling the tool using the rigid leveling link.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1A:
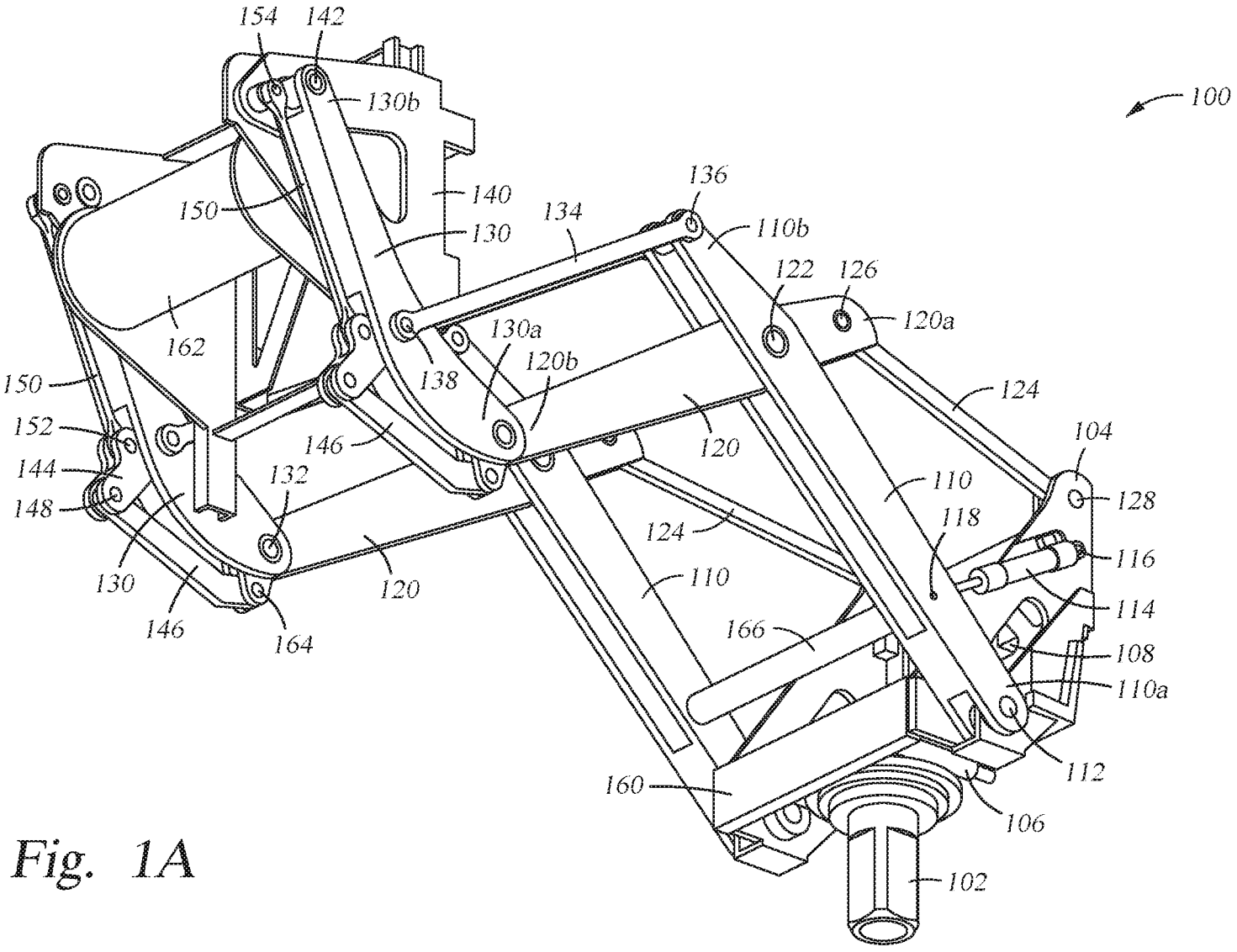
FIG. 1A is a schematic perspective view of a positioning tool according to one embodiment of the present disclosure.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

Embodiments of the present disclosure generally relate to apparatus and methods for handling wellbore tools. More particularly, embodiments of the present disclosure generally relate to an apparatus for positioning a tool, such as a tong, a pipe-stabilizing tool, a gripping arm, welding equipment or any other wellbore equipment. To better understand the aspects of the present disclosure and the methods of use thereof, reference is hereafter made to the accompanying drawings.

Figure 1B:
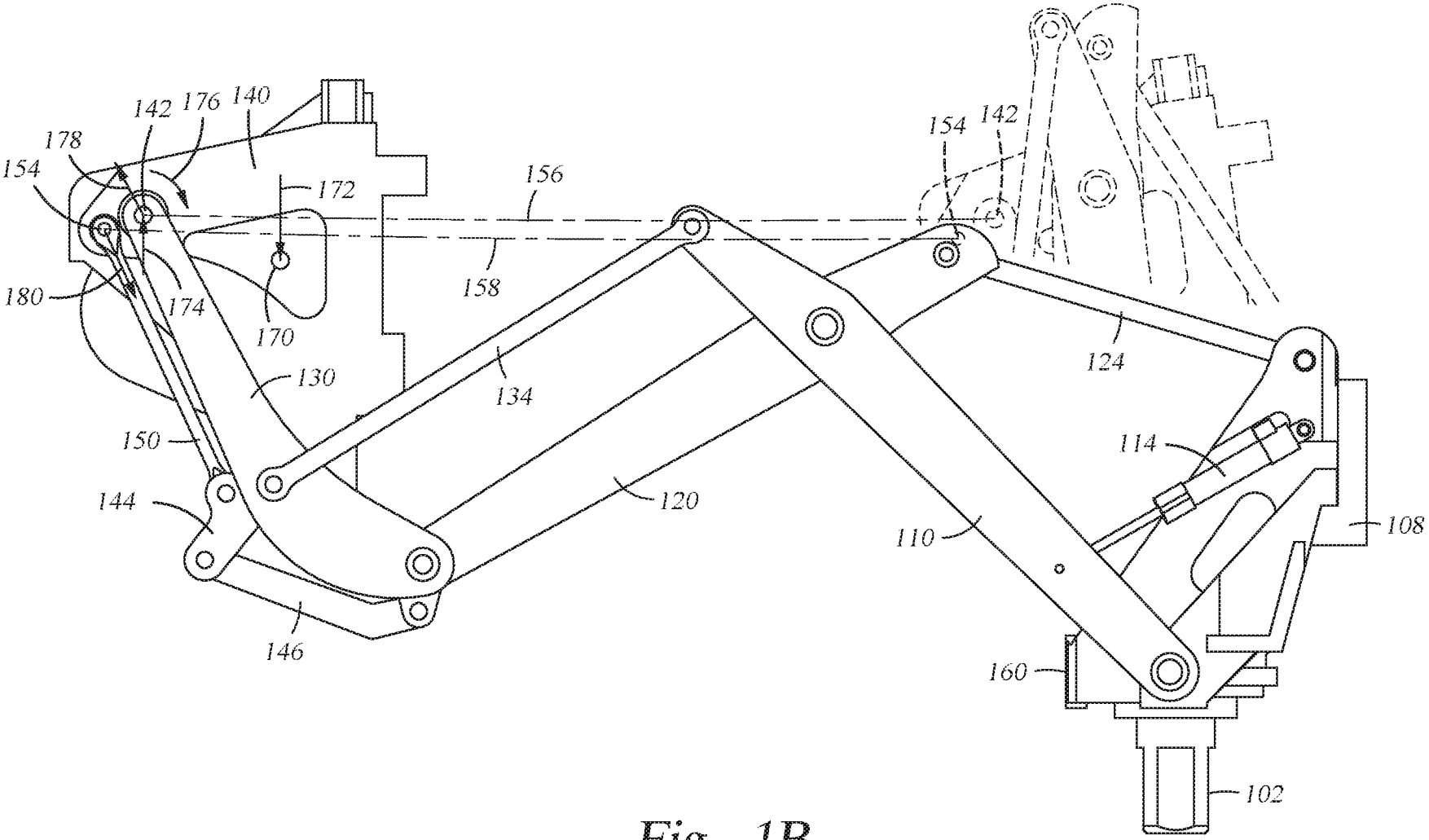
FIG. 1B is a schematic side view of the positioning tool of FIG. 1A in an extended position.
Figure 1C:
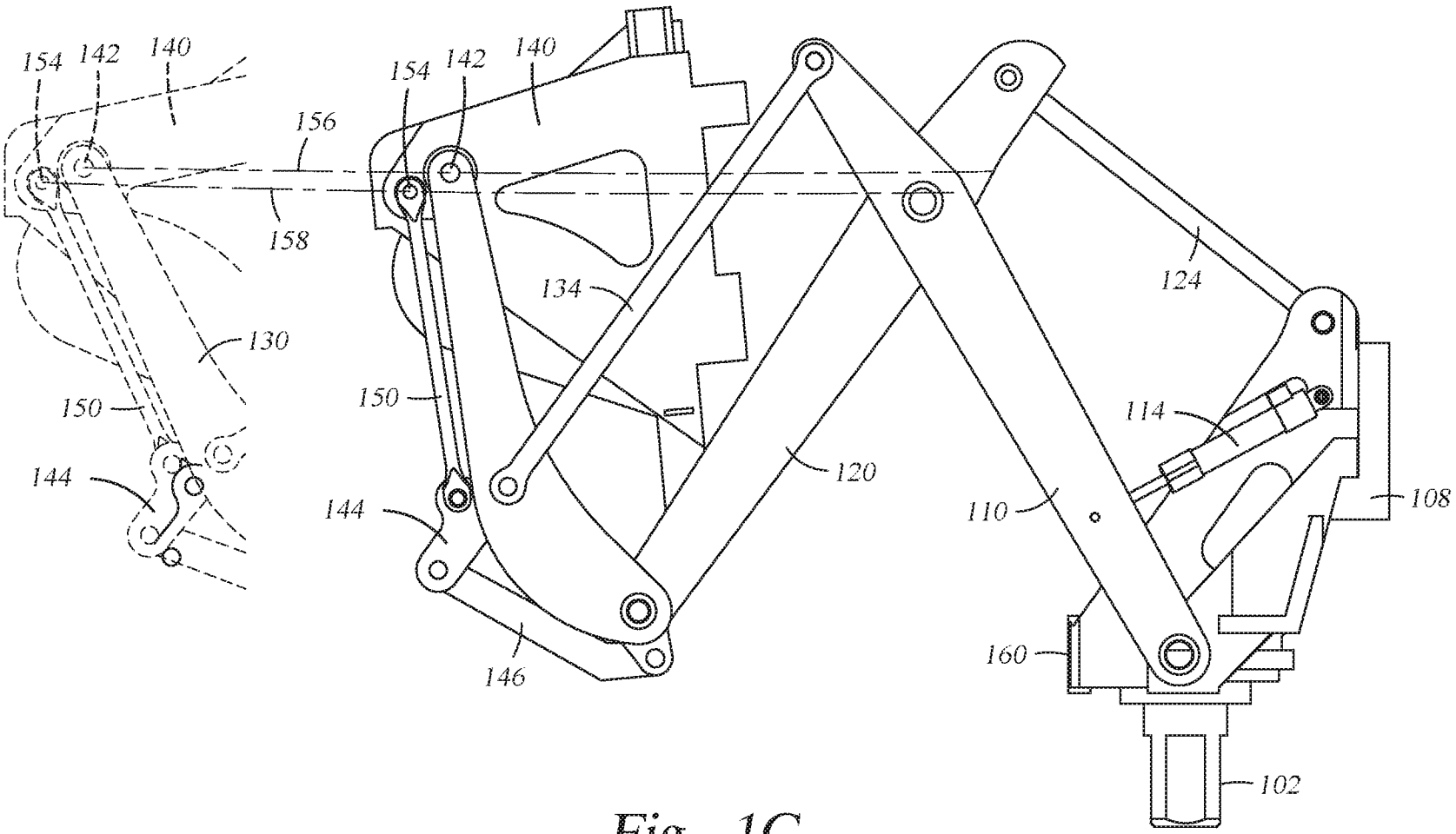
FIG. 1C is a schematic side view of the positioning tool of FIG. 1A in an intermediate position.
Figure 1D:
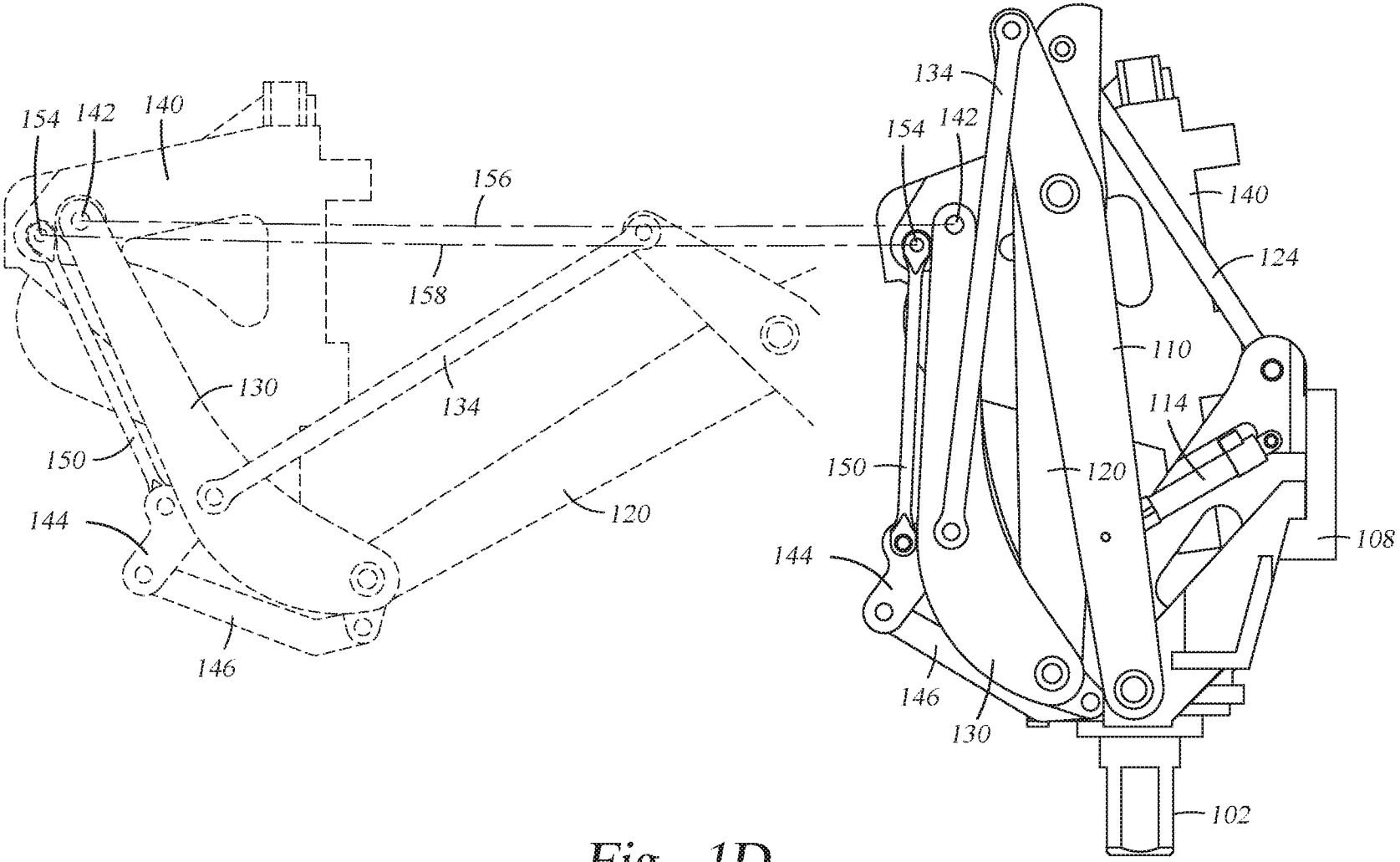
FIG. 1D is a schematic side view of the positioning tool of FIG. 1A in a retracted position.

FIG. 1A is a schematic perspective view of a positioning tool 100 according to one embodiment of the present disclosure. The positioning tool 100 may be used to position a tool at a wellsite. The positioning tool 100 uses a retractable arm assembly to move a tool adaptor between a retracted position and an extended position. The positioning tool 100 also includes a leveling assembly attached to the last two arms in the retractable arm assembly to level and stabilize the tool adaptor. The leveling assembly includes rigid structures. FIG. 1B is a schematic side view of the positioning tool 100 in the extended position. FIG. 1C is a schematic side view of the positioning tool 100 in an intermediate position. FIG. 1D is a schematic side view of the positioning tool 100 in a retracted position.

The positioning tool 100 includes a base column 102 for mounting the positioning tool 100 at a wellsite. A frame member 104 is movably connected to the base column 102. In one embodiment, a frame actuator 106 is coupled between the frame member 104 and the base column 102. The frame actuator 106 is configured to move the frame member 104 relative to the base column 102. In one embodiment, the frame actuator 106 may rotate the frame member 104 relative to the base column 102. In another embodiment, the frame actuator 106 may raise and lower the frame member 104. In another embodiment, the frame actuator 106 may rotate and raise and lower the frame member 104 relative to the base column 102. The frame actuator 106 may include one or more suitable actuators for rotating and lifting the frame member 104. The frame actuator 106 may include a motor, such as a hydraulic motor, to rotate the frame member 104, and a cylinder, such as a hydraulic or pneumatic cylinder to move the frame member 104 vertically.

The retractable arm assembly is attached to the frame member 104 so that the retractable arm assembly moves with the frame member 104, for example rotating about the base column 102 and moving vertically relative to the base column 102. In one embodiment, the retractable assembly includes a drive arm 110. The drive arm 110 is movably coupled to the frame member 104. An arm actuator 114 is connected to the drive arm 110 and configured to move the drive arm 110 relative to the frame member 104. The drive arm 110 is connected to an end arm 130 via an intermediate arm 120. A tool adaptor 140 is connected to the end arm 130. The tool adaptor 140 is configured to grip and support a tool, such as a tong. A link 124 connects between the frame member 104 and the intermediate arm 120. A link 134 connects between the drive arm 110 and end arm 130. The links 124, 134 constrains the movement of the intermediate arm 120 and the end arm 130 to realize a target trajectory of the tool adaptor 140 in response to the motion of the drive arm 110.

In FIG. 1A, the end arm 130 is connected to the drive arm 110 via one intermediate arm 120. Alternatively, the end arm 130 may be directly connected to the drive arm 110. Alternatively, two or more intermediate arms 120 may be connected in series between the drive arm 110 and the end arm 130 depending on the range of the tool adaptor 140.

The leveling assembly may include rigid structures coupled to the end arm 130 and the intermediate arm 120 to maintain a desired orientation of the tool adaptor 140. For example, the leveling assembly may be used to prevent the tool adaptor 140 from tilting as the positioning tool 100 moves between the extended position and the retracted position. In some embodiments, the leveling assembly may include rigid structures coupling the end arm 130 to two or more arms to improve accuracy of the trajectory. For example, the leveling assembly may include rigid structures coupling the end arm 130 to the intermediate arm 120 and the drive arm 110. The leveling assembly uses relative movement between the end arm 130 and the arm directly connected to the end arm 130 to level the tool adaptor 140 attached to the end arm 130. In the embodiment shown in FIG. 1A, the leveling assembly is connected to the end arm 130 and the intermediate arm 120. In the embodiment where the end arm 130 is directly connected to the drive arm 110, the leveling assembly is connected to the end arm 130 and the drive arm 110.

In one embodiment, the leveling assembly includes a leveling arm 144 coupled to the end arm 130, a stabilizing link 146 coupled between the leveling arm 144 and the intermediate arm 120, and a leveling link 150 coupled between the leveling arm 144 and the tool adaptor 140. In one embodiment, the leveling link 150 includes an elongated rigid body. The leveling link 150 and the end arm 130 are coupled to the tool adaptor 140 at two different locations. The rigid structures in the leveling assembly absorb tension or compression from the tool adaptor 140 during operation thus preventing the tool adaptor 140 from tilting.

In the embodiment of FIG. 1A, the positioning tool 100 includes a pair of arm assemblies arranged in symmetry and synchronized to move the tool adaptor 140. The frame member 104 may include one or more bar members 160 and a pair of drive arms 110 may be positioned on opposite ends of the bar member 160. The bar member 160 and the tool adaptor 140 may be sized to ensure that the pair of arm assemblies stay parallel to each other.

In the embodiment of FIG. 1A, a first end 110*a* of the drive arm 110 is pivotably attached to the frame member 104 by a joint 112. The intermediate arm 120 and the drive arm 110 are pivotably coupled together by a joint 122. The joint 122 is located at a middle portion of the drive arm 110 between the first end 110*a* and a second end 110*b*. The joint 122 is located in at middle portion of the intermediate arm 120 between a first end 120*a* and a second end 120*b*. The link 124 is pivotably coupled to the frame member 104 by a joint 128. The link 124 is pivotably coupled to the first end 120*a* of the intermediate arm 120 by a joint 126. A first end 130*a* of the end arm 130 and the second end of 120*b* the intermediate arm 120 are pivotably coupled together by a joint 132. A second end 130*b* of the end arm 130 is pivotably coupled to the tool adaptor 140 by a joint 142. The link 134 is coupled between the drive arm 110 and the end arm 130. The link 134 connects the drive arm 110 and the end arm 130. The link 134 is pivotably attached to the second end 110*b* of the drive arm 110 by a joint 136. The link 134 is pivotably attached to the end arm 130 by a joint 138 located at a middle portion of the end arm 130 between the first end 130*a* and the second end 130*b*.

In the embodiment of FIG. 1A, the leveling arm 144 is pivotably connected to the end arm 130 by the joint 138. Alternatively, the leveling arm 144 may be pivotably connected to the end arm 130 by a joint independent from the joint 138. The stabilizing link 146 connects the leveling arm 144 and the intermediate arm 120. A joint 164 pivotably connects the stabilizing link 146 to the intermediate arm 120. A joint 148 pivotably connects the stabilizing link 146 to the leveling arm 144. The leveling link 150 connects the leveling arm 144 and the tool adaptor 140. A joint 154 pivotably connects the leveling link 150 and the tool adaptor 140. A joint 152 pivotably connects the leveling link 150 to the leveling arm 144.

During operation, loads on the positioning tool 100, such as the weight of the tool adaptor 140 and the weight of the tool, apply a load force 172 at a center of the gravity 170. The end arm 130 reacts to the load force 172 at the joint 142 with a react force 174. The force pair 172, 174 creates a moment 176 which would rotate the tool adaptor 140 clockwise about the joint 142. The leveling link 144 prevents the tool adaptor 140 from rotating by creating a second force pair 178 and 180, thus stabilizing the tool adaptor 140.

In the embodiment shown in FIG. 1B, the joints 142 and 154 are located in the tool adaptor 140 on the same side of the center of gravity 170 of the tool adaptor 140, resulting the leveling 144 under tension. When the joints 142 and 154 are located on opposite sides of the center of gravity 170, the leveling link 144 would be compressed during operation.

The arm actuator 114 is configured to rotate the drive arm 110 relative to the frame member 104 about the joint 112. The rotation of the drive arm 110 causes the intermediate arm 120 and the end arm 130 to extend and to retract. In one embodiment, the arm actuator 114 is a cylinder having one end pivotably connected to the frame member 104 by a joint 116 and another end pivotably connected to the drive arm 110 by a joint 118. The joint 118 may be located at a middle portion of the drive arm 110 between the ends 110*a* and 110*b*. The extension and retraction of the cylinder cause the drive arm 110 to rotate about the joint 112. In one embodiment, each of the two drive arms 110 has an arm actuator 114 attached thereto. A control panel 108 may be used to synchronize the arm actuators 114 to synchronize the movement of the drive arms 110. Alternatively, a single arm actuator 114 may be used to drive both drive arms 110. For example, the arm actuator 114 may be disposed between the frame member 104 and a bar member 166 connecting the two drive arms 110.

In one embodiment, the arm actuators 110 are hydraulic counterbalance cylinders. The hydraulic counterbalance cylinders lock in position if hydraulic pressure is lost in the system, thereby functioning as a pipe break safety valve. Generally, the hydraulic counterbalance cylinders include a check valve arrangement on the rod side of the cylinder. The check valve can be opened by pilot pressure. The pressure on the incoming line on the piston side of the cylinder is used to open the check valve arrangement on the rod side. If the pressure on the incoming line is lost, then the check valve arrangement closes and the rod is locked in place. The locking of the rod causes the positioning tool 100 to become locked so that the load carried thereon will not be dropped if hydraulic pressure in the system is lost. Alternatively, piston area or both chambers of the hydraulic counterbalance cylinder can be locked. Alternatively, the arm actuator 114 may be other suitable form of actuators, such as a hydraulic motor, a linear unit, such as spindles.

During operation, the arm actuator 114 extends to rotate the drive arm 110 counter clockwise and extend the positioning tool 100 and retracts to rotate drive arm 110 clockwise and retract the positioning tool 100 as shown in FIGS. 1B, 1C, and 1D. In one embodiment, dimensions of the drive arm 110, intermediate arm 120, end arm 130, the link 124, and link 134, and locations of the joints 112, 116, 118, 122, 126, 128, 132, 136, 138, and 142 are selected, for example, by optimization, so that a trajectory 156 of the joint 142 stays substantially horizontal between the extended position in FIG. 1B to the retracted position in FIG. 1D. In one embodiment, the trajectory 156 can be tuned by adjusting the length of one or more components, for example, the link 124 or the link 134, or by using eccentric bolts to change the joint position.

To keep the tool adaptor 140 level during the operation, a trajectory 158 of the joint 154 is designed to stay substantially parallel to the trajectory 156. The dimensions of the leveling arm 144, the leveling link 150, and the stabilizing link 146, and locations of the joints 148, 152, 154, and 164 are selected, for example, by optimization, to allow the trajectory 158 parallel to the trajectory 156. In one embodiment, a length of one or more components in the leveling assembly, such as the leveling link 150 may be adjustable to tune to trajectory 158.

Even though the positioning tool 100 includes a pair of retractable arm assembly and a pair of leveling assembly, embodiments of the present disclosure may include a single retractable arm assembly and a single leveling assembly.

Figure 2A:
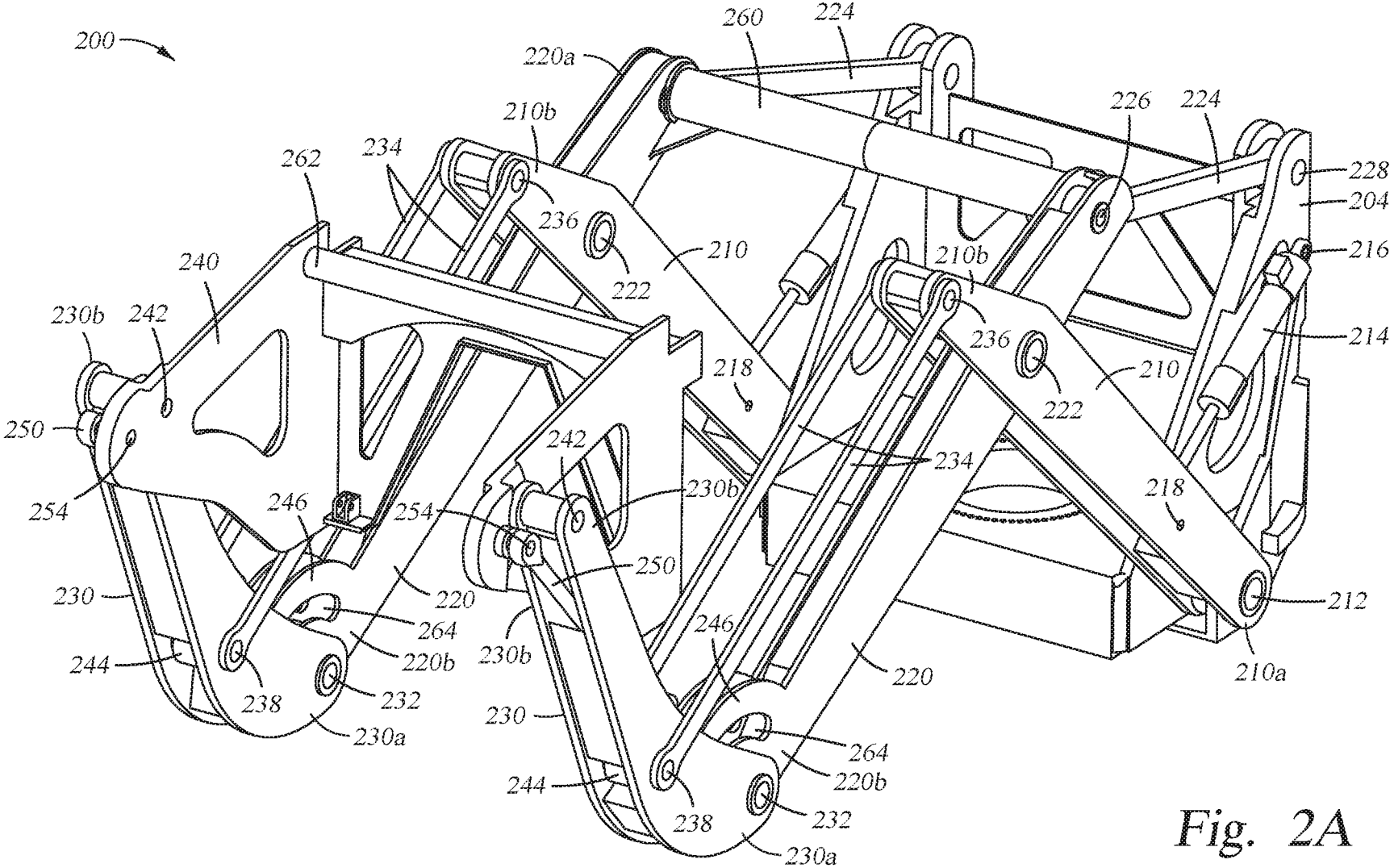
FIG. 2A is a schematic perspective view of a positioning tool according to another embodiment of the present disclosure.
Figure 2B:
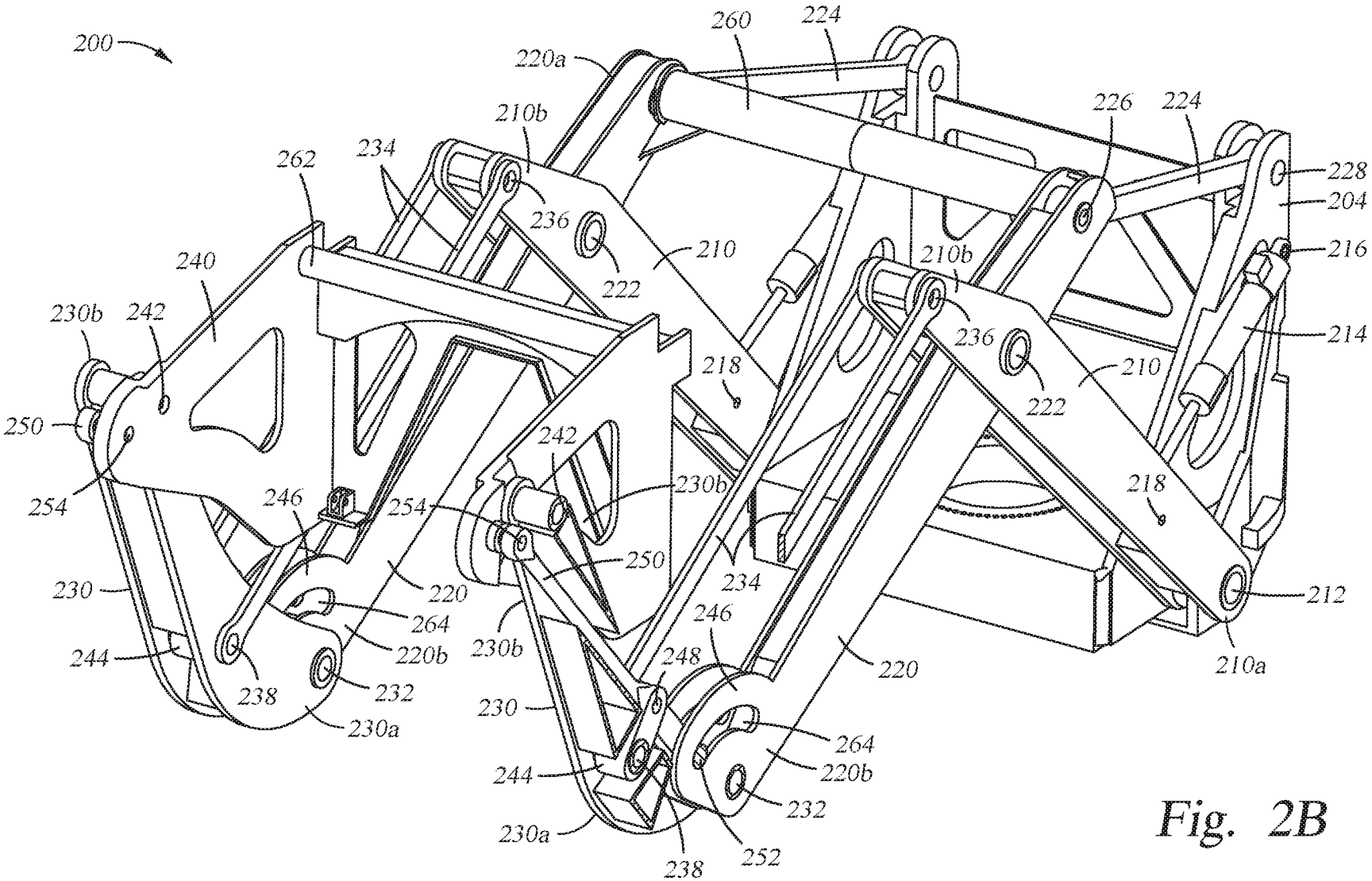
FIG. 2B is a schematic perspective view of the positioning tool of FIG. 2A showing details of a leveling assembly.
Figure 2C:
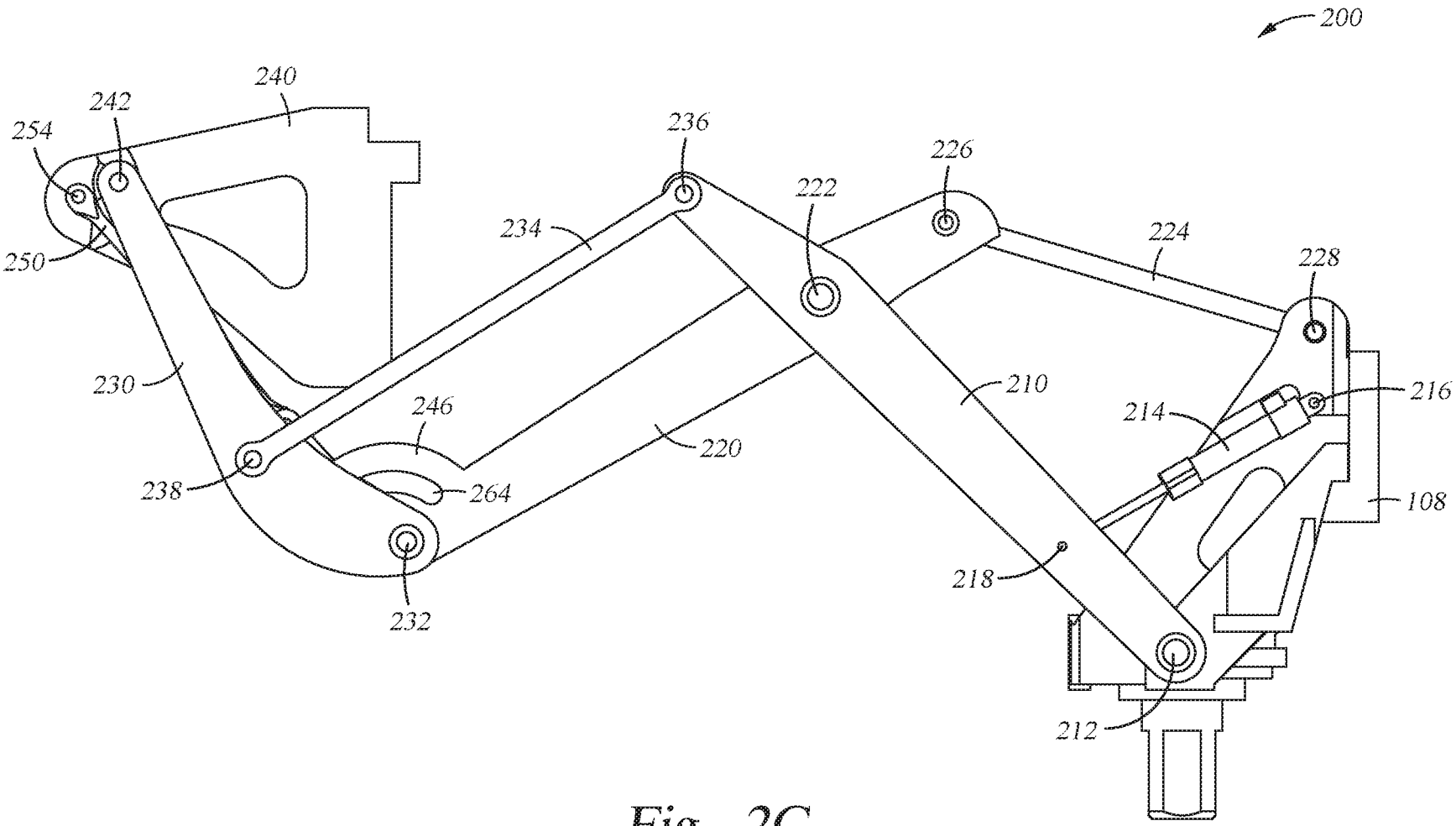
FIG. 2C schematic side view of the positioning tool of FIG. 2A in an extended position.
Figure 2D:
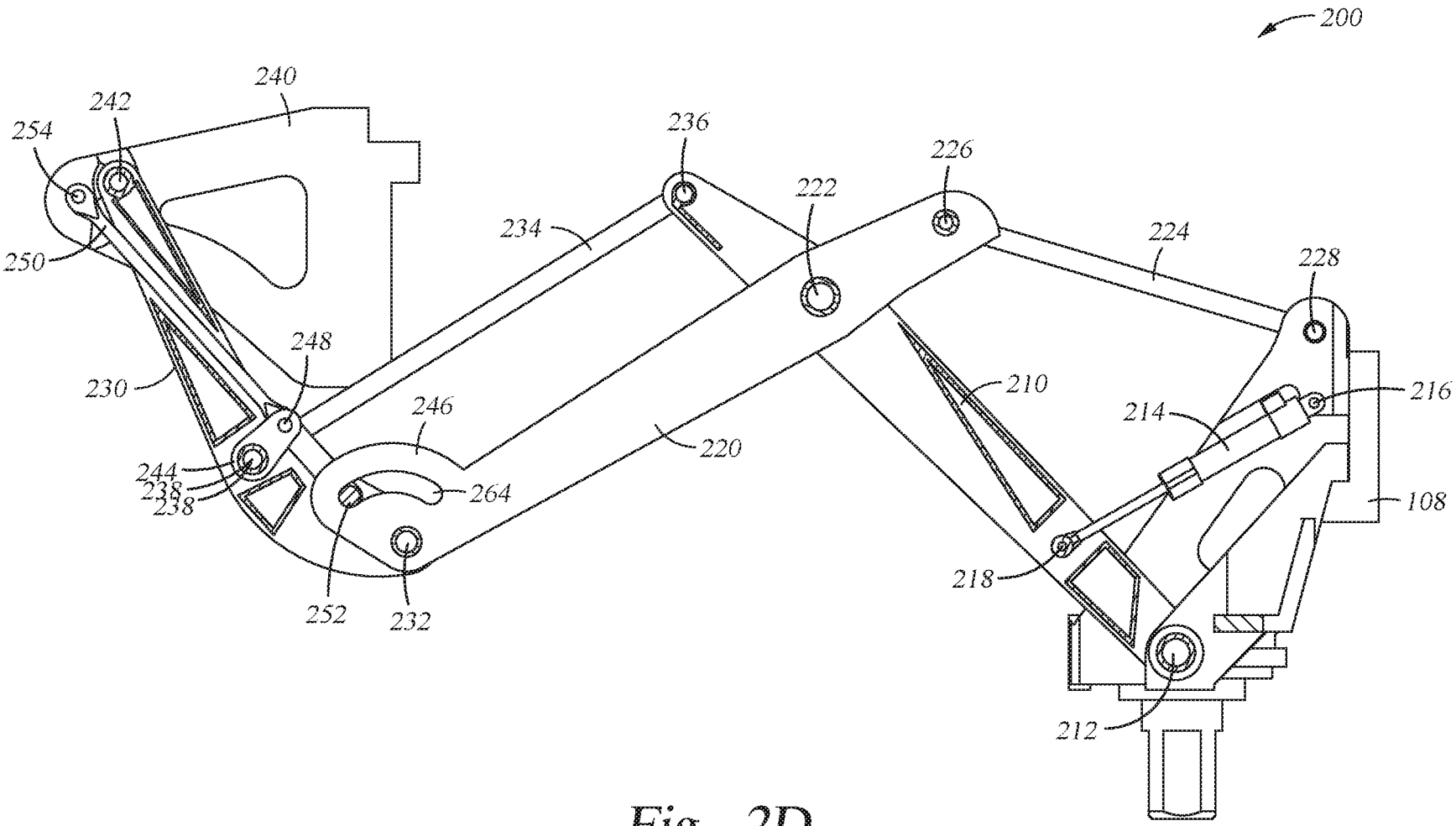
FIG. 2D schematic side view of the positioning tool of FIG. 2A in the extended position showing the leveling assembly.
Figure 2E:
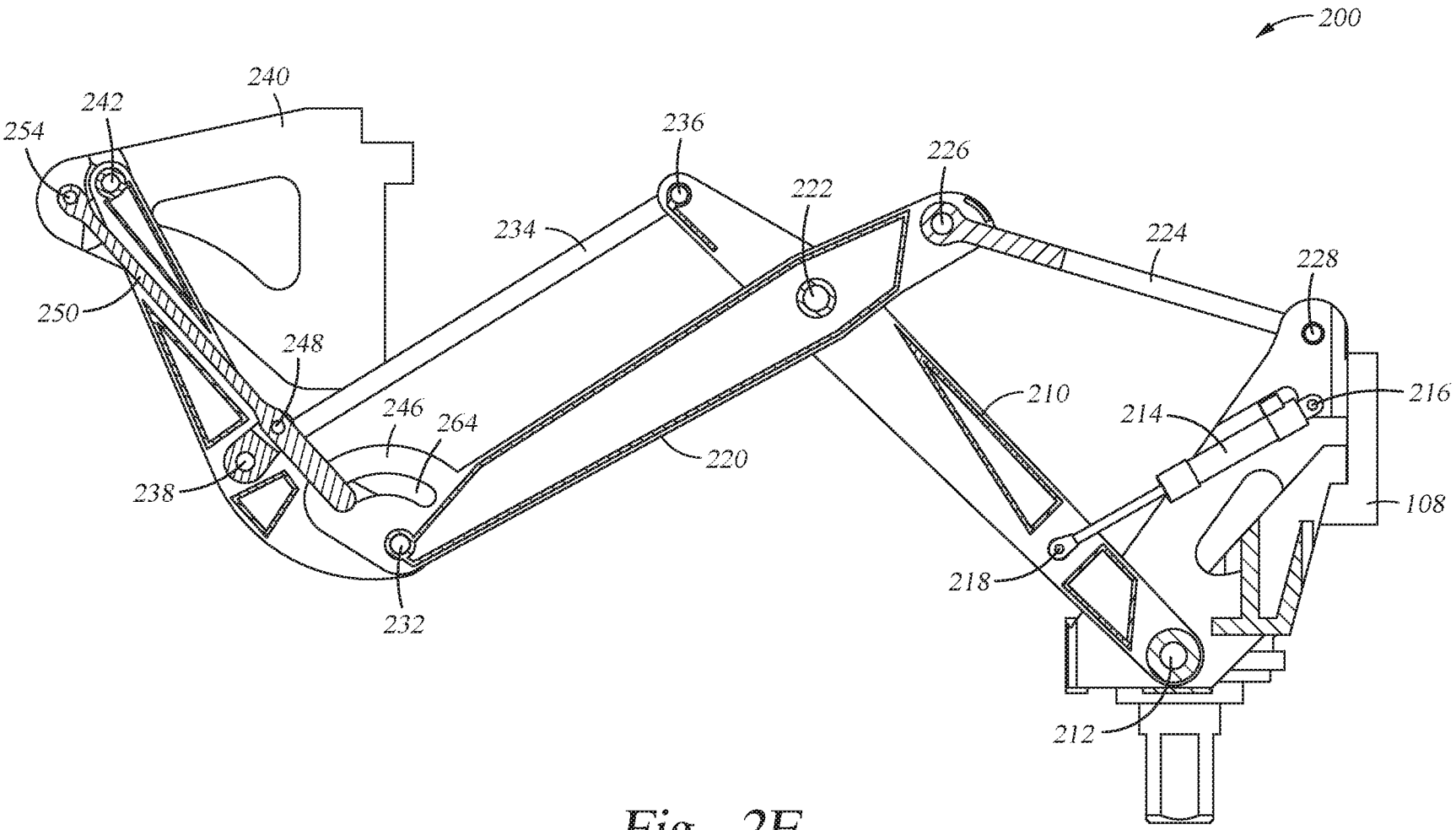
FIG. 2E schematic side view of the positioning tool of FIG. 2A in the extended position showing the leveling assembly.
Figure 2F:
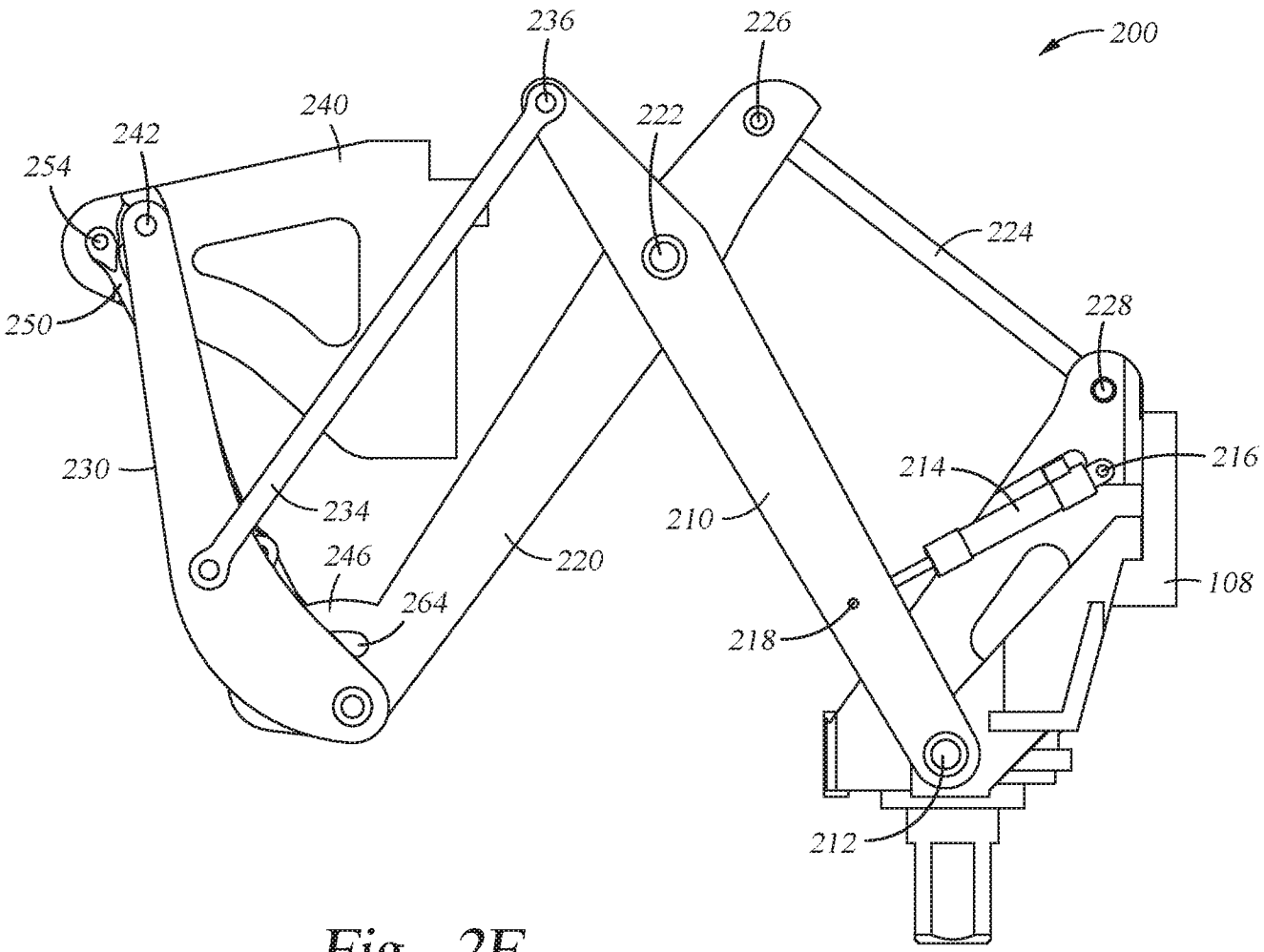
FIG. 2F is a schematic side view of the positioning tool of FIG. 2A in an intermediate position.
Figure 2G:
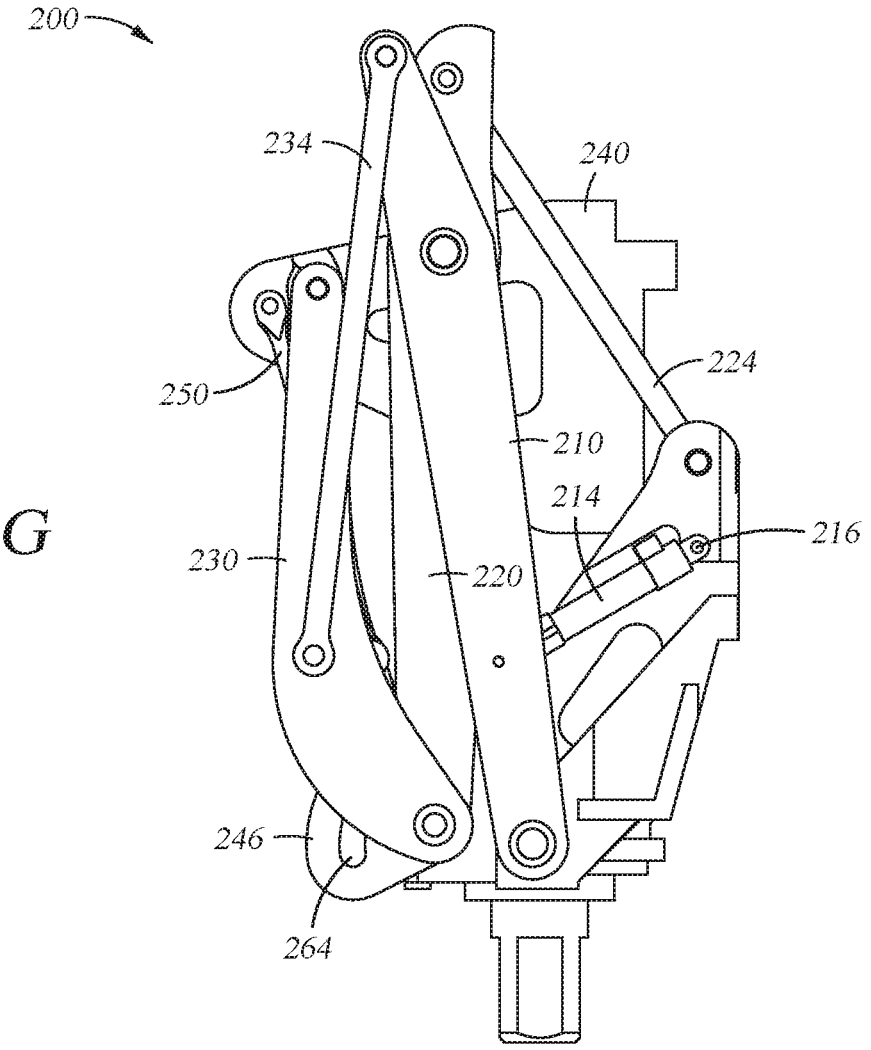
FIG. 2G is a schematic side view of the positioning tool of FIG. 2A in a retracted position.

FIG. 2A is a schematic perspective view of a positioning tool 200 according to another embodiment of the present disclosure. The positioning tool 200 is similar to the positioning tool 100 except with a different leveling assembly. FIG. 2B is a schematic perspective view of the positioning tool 200 showing a leveling assembly. FIG. 2C schematic side view of the positioning tool 200 in an extended position. FIG. 2D schematic side view of the positioning tool 200 in the extended position showing the leveling assembly. FIG. 2E schematic side view of the positioning tool 200 in the extended position showing the leveling assembly. FIG. 2F is a schematic side view of the positioning tool 200 in an intermediate position. FIG. 2G is a schematic side view of the positioning tool 200 in a retracted position.

The positioning tool 200 includes a frame member 204. Similar to the frame member 104 of the positioning tool 100, the frame member 204 may be movably connected to a base member secured to a wellsite. The frame member 204 may rotate and move vertically relative to the base member.

A retractable arm assembly is attached to the frame member 204. The retractable assembly includes a drive arm 210. The drive arm 210 is movably coupled to the frame member 204 by an arm actuator 214. The drive arm 210 is connected directly or indirectly to an end arm 230 via an intermediate arm 220. A tool adaptor 240 is connected to the end arm 230. The tool adaptor 240 is configured to grip and support a tool, such as a tong. A link 224 connects between the frame member 104 and the intermediate arm 220. A link 234 connects between the drive arm 210 and end arm 230. The links 224, 234 constrains the movement of the intermediate arm 220 and the end arm 230 to realize a target trajectory of the tool adaptor 240 in response to the motion of the drive arm 210.

In FIG. 2A, the end arm 230 is connected to the drive arm 210 via one intermediate arm 220. Alternatively, the end arm 230 may be directly connected to the drive arm 210. Alternatively, two or more intermediate arms 220 may be connected in series between the drive arm 210 and the end arm 230 depending on the range of the tool adaptor 240.

The leveling assembly of the positioning tool 200 includes rigid structures coupled to the end arm 230 and the intermediate arm 220 to maintain a desired orientation of the tool adaptor 240. For example, the leveling assembly may be used prevent the tool adaptor 240 from tilting as the positioning tool 200 moves between the extended position and the retracted position. The leveling assembly uses relative movement between the end arm 230 and the arm directly connected to the end arm 230 to level the tool adaptor 240 attached to the end arm 230. In the embodiment shown in FIG. 2A, the leveling assembly is connected to the end arm 230 and the intermediate arm 220. In the embodiment where the end arm 230 is directly connected to the drive arm 210, the leveling assembly is connected to the end arm 230 and the drive arm 210.

FIG. 2B is a schematic perspective view of the positioning tool 200 showing details of the leveling assembly. In one embodiment, the leveling assembly includes a leveling arm 244 coupled to the end arm 230, a stabilizing cam 246 attached to the intermediate arm 220, and a leveling link 250 coupled to the leveling arm 244, the stabilizing cam 246, and the tool adaptor 240. The leveling link 250 and the end arm 230 are coupled to the tool adaptor 240 at two different locations. The rigid structures in the leveling assembly absorb tension or compression from the tool adaptor 240 during operation thus preventing the tool adaptor 240 from tilting.

In the embodiment of FIGS. 2A and 2B, the positioning tool 200 includes a pair of arm assemblies arranged in symmetry and synchronized to move the tool adaptor 240. A pair of drive arms 210 may be positioned on opposite sides of the frame member 204. The tool adaptor 240 may include one or more bar members 260/262 and a pair of end arms 240 are positioned on opposite ends of the bar member 262. A bar member 260 may be disposed between the two intermediate arms 220. The bar member 260 and the bar member 262 may be sized to ensure that the pair of arm assemblies stay parallel to each other.

In the embodiment of FIG. 2A, a first end 210*a* of the drive arm 210 is pivotably attached to the frame member 204 by a joint 212. The intermediate arm 220 and the drive arm 210 are pivotably coupled together by a joint 222. The joint 222 is located at a middle portion of the drive arm 210 between the first end 210*a* and a second end 210*b*. The joint 222 is located in at middle portion of the intermediate arm 220 between a first end 220*a* and a second end 220*b*. The link 224 is pivotably coupled to the frame member 204 by a joint 228. The link 224 is pivotably coupled to the first end 220*a* of the intermediate arm 220 by a joint 226. A first end 230*a* of the end arm 230 and the second end of 220*b* the intermediate arm 220 are pivotably coupled together by a joint 232. A second end 230*b* of the end arm 230 is pivotably coupled to the tool adaptor 240 by a joint 242. The link 234 is coupled between the drive arm 210 and the end arm 230. The link 234 connects the drive arm 210 and the end arm 230. The link 234 is pivotably attached to the second end 210*b* of the drive arm 210 by a joint 236. The link 234 is pivotably attached to the end arm 230 by a joint 238 located at a middle portion of the end arm 230 between the first end 230*a* and the second end 230*b*.

As shown in FIG. 2B, the leveling arm 244 is pivotably connected to the end arm 230 by the joint 238. The stabilizing cam 246 is fixedly attached to the intermediate arm 220 or formed on the intermediate arm 220. The stabilizing cam 246 includes a roller slot 264. The leveling link 250 is coupled to the stabilizing cam 246, the leveling arm 144, and the tool adaptor 140. A joint 254 pivotably connects the leveling link 250 and the tool adaptor 240. A joint 248 pivotably connects the leveling link 250 to the leveling arm 244. The leveling link 250 includes a roller 252. The roller 252 engages the roller slot 246 in the stabilizing cam 246 to movably couple the leveling link 250 and the stabilizing cam 246. The joint 248 is located in a middle portion of the leveling link 250 between the joint 254 and the roller 252.

During operation, loads on the positioning tool 200, such as the weight of the tool adaptor 240 and the weight of the tong, apply a load force at a center of the gravity of the tool adaptor 240. The end arm 230 reacts to the load force at the joint 242 with a react force. The force pair of load force and react force creates a moment, which would rotate the tool adaptor 240 clockwise about the joint 242. The leveling link 250 prevents the tool adaptor 240 from rotating by creating a second force pair thus stabilizing the tool adaptor 240.

In the embodiment shown in FIG. 2B, the joints 242 and 254 are located in the tool adaptor 240 on the same side of the center of gravity of the tool adaptor 240, resulting the leveling link 250 under tension. When the joints 242 and 254 are located on opposite sides of the center of gravity of the tool adaptor 240, the leveling link 250 would be compressed during operation.

The arm actuator 214 is configured to rotate the drive arm 210 relative to the frame member 204 about the joint 212. The rotation of the drive arm 210 causes the intermediate arm 220 and the end arm 230 to extend and to retract. In one embodiment, the arm actuator 214 is a cylinder having one end pivotably connected to the frame member 204 by a joint 216 and another end pivotably connected to the drive arm 210 by a joint 218. The joint 218 may be located at a middle portion of the drive arm 210 between the ends 210*a* and 210*b*. The extension and retraction of the cylinder cause the drive arm 210 to rotate about the joint 212. In one embodiment, each of the two drive arms 210 has an arm actuator 214 attached thereto. A control panel, not shown, may be used to synchronize the arm actuators 214 to synchronize the movement of the drive arms 210. Alternatively, a single arm actuator 214 may be used to drive both drive arms 210. For example, the arm actuator 214 may be disposed between the frame member 204 and a bar member, not shown, connecting the two drive arms 210. In one embodiment, the arm actuators 210 are hydraulic counterbalance cylinders to allow the positioning tool 200 to become locked so that the load carried thereon will not be dropped if hydraulic pressure in the system is lost.

During operation, the arm actuator 214 extends to rotate the drive arm 210 counter clockwise and extend the positioning tool 200 and retracts to rotate drive arm 210 clockwise and retract the positioning tool 200 as shown in FIGS. 2C, 2F, and 2G. In one embodiment, dimensions of the drive arm 210, intermediate arm 220, end arm 230, the link 224, and link 234, and locations of the joints 212, 216, 218, 222, 226, 228, 232, 236, 238, and 242 are selected, for example, by optimization, so that a trajectory of the joint 242 stays substantially horizontal between the extended position in FIG. 2C to the retracted position in FIG. 2G. In one embodiment, the trajectory of the joint 242 can be tuned by adjusting the length of one or more components, for example, the link 224 or the link 234. Or adjust the joint position by turning of excentric bolts.

To keep the tool adaptor 240 level during the operation, a trajectory of the joint 254 is designed to stay substantially parallel to the trajectory of the joint 242. The dimensions of the leveling arm 244, the leveling link 250, and the stabilizing cam 246, locations of the joints 248, 254, the location of the roller 252, and the contour of the roller slot 264 are selected, for example, by optimization, to allow the trajectory of the joint 254 parallel to the trajectory of the joint 242. In one embodiment, a length of one or more components in the leveling assembly, such as the leveling link 250 may be adjustable to tune to trajectory of the joint 254. Alternatively, eccentric bolts may be used to adjust the location of the joints to tune the positioning tool 200.

Even though the positioning tool 200 includes a pair of retractable arm assembly and a pair of leveling assembly, embodiments of the present disclosure may include a single retractable arm assembly and a single leveling assembly.

Figure 3:
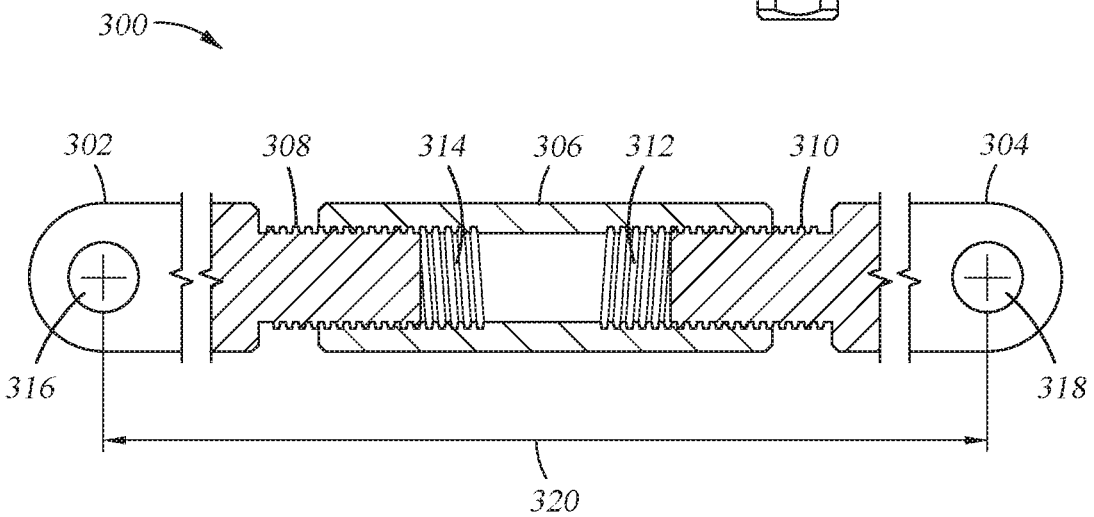
FIG. 3 is a schematic sectional view of an adjustable link according to one embodiment of the present disclosure.

FIG. 3 is a schematic sectional view of an adjustable link 300 according to one embodiment of the present disclosure. The adjustable link 300 may be used as any links or arms in the positioning tool 100, 200 to permit adjustment or tuning of the positioning tool 100, 200. For example, the adjustable link 300 may be used in place of the link 124, 134, 150, 224, 234, 250.

The adjustable link 300 may include a first section 302 and a second section 304 connected by an adjustment section 306. The first section 302 may have an elongated body having a joint adaptor 316 for forming a joint with another structure at one end, and a threaded portion 308 for connecting to the adjustment section 306 at a second end. The second section 304 may have an elongated body having a joint adaptor 318 for forming a joint with another structure at one end and a threaded portion 310 for connecting to the adjustment section 306 at a second end. The threaded portions 308, 310 have threads of different directions. For example, the threaded portion 308 has a left-hand thread while the thread portion 310 as a right-hand thread, or vice versa. The adjustment section 306 may be a rod having threaded portions 312, 314 formed on opposite ends. The threaded portions 312, 314 are coupled to the threaded portions 310, 308 respectively. When the adjustable link 300 is attached to other structures at the joint adaptors 316, 318, turning the adjustment section 306 threads or unthreads the threaded connections with between the threaded portions, thus lengthening or shortening a length 320 between the joint adaptors 316, 318.

Embodiments of the present disclosure provide a positioning tool having a leveling assembly coupled to the last two arms of a retractable arm assembly. The leveling assembly includes rigid structures connected to the last two arms using the relative movement of the last two arms to prevent a load on the positioning tool from tilting. The positioning tool of the present disclosure is capable of limiting the tilting of the load, such as a tong, to be within ±0.5 degree over the full horizontal stroke.

Compared to the other leveling mechanisms, such as a chain leveling mechanism, the leveling assembly of the present disclosure reduces the number of parts and the structure complexity, thus, lowering costs of manufacturing and maintenance. The leveling assembly of the present disclosure also further reduces tilting compared to a chain leveling mechanism because winding a chain on a roller inherently changes the length of the chain slightly, thus, causing tilting. The leveling assembly of the present disclosure uses rigid structures takes over pressure, therefore, reducing preload at the leveling assembly and the retractable arm assembly. Unlike a chain leveling mechanism, the leveling assembly of the present disclosure does not need high alloyed steels, therefore, avoids hydro carbonizing problem associated with the high alloyed steel. Further, the leveling assembly of the present disclosure can be easily tuned. Additionally, the rigid leveling assembly according to the present disclosure allows the leveling assembly to react in tension and compression to stabilize the tool while traditional leveling assembly, such as chain leveling assembly, react in tension only. Thus, embodiments of the present disclosure provide more variation in design.

One embodiment of the present disclosure provides a positioning tool. The positioning tool includes a retractable arm assembly including a first arm, a second arm, wherein a first end of the first arm is pivotably coupled to the second arm and a second end of the first arm is pivotably coupled to a tool adaptor, and a leveling assembly including a leveling arm pivotably coupled to the first arm, a leveling link pivotably coupled to the tool adaptor and the leveling arm, wherein one of the leveling arm and the leveling link is connected to the second arm.

In one or more embodiments, the leveling link comprises an elongated rigid body connected to the tool adaptor by a first joint and connected to the leveling arm by a second joint.

In one or more embodiments, the elongated body includes a first section connected to the first joint, a second section connected to the second joint, and an adjustment section connected between the first and second section by threaded connections of different directions, wherein turning the adjustment section lengthens or shortens a distance between the first joint and the second joint.

In one or more embodiments, the leveling assembly further includes a stabilizing link, wherein the leveling arm is connected to the second arm by the stabilizing link.

In one or more embodiments, the stabilizing link has a first end pivotably connected to the leveling arm and a second end pivotably connected to the second arm.

In one or more embodiments, the positioning tool further includes a stabilizing cam attached to the second arm, wherein the leveling link includes a roller disposed in a roller slot in the stabilizing cam.

In one or more embodiments, the stabilizing cam is formed on the second arm.

In one or more embodiments, the retractable arm assembly further includes a frame member, and an arm actuator coupled between the frame member and the second arm, wherein the arm actuator is configured to rotate the second arm relative to the frame member, and rotation of the second arm causes the first arm and the second arm to extend or retract, thereby, moving the tool adaptor.

In one or more embodiments, the retractable arm assembly further includes a third arm pivotably coupled to the second arm, a frame member, and an arm actuator coupled between the frame member and the third arm, wherein the arm actuator is configured to rotate the third arm relative to the frame member, and rotation of the third arm causes the first arm, the second arm, and third arm to extend or retract, thereby, moving the tool adaptor.

In one or more embodiments, the retractable arm assembly further includes a first link pivotably connecting the first arm and the third arm, and a second link pivotably connecting the second arm and the frame member.

Another embodiment provides a positioning tool. The positioning tool includes a drive arm movably connected to a frame member, an end arm in connection with the drive arm, wherein an end arm is pivotably coupled to a tool adaptor, and rotation of the drive arm extends or retracts the end arm moving the tool adaptor along a trajectory, a leveling arm pivotably coupled to the end arm, and a leveling link having an elongated body pivotably connected between the tool adaptor and the leveling arm.

In one or more embodiments, the positioning tool further includes an intermediate arm connected between the drive arm and the end arm, wherein one of the leveling arm and the leveling link is connected with the intermediate arm.

In one or more embodiments, the positioning tool further includes a stabilizing link, wherein the stabilizing link is pivotably connected between the leveling arm and the intermediate arm.

In one or more embodiments, the positioning tool further includes a stabilizing cam attached to the intermediate arm, wherein the leveling link includes a roller movable along a roller slot in the stabilizing cam.

In one or more embodiments, the drive arm and the end arm are pivotably connected by a joint, and one of the leveling arm and the leveling link is connected with the drive arm.

In one or more embodiments, the leveling link is connected to the tool adaptor by a first joint and connected to the leveling arm by a second joint.

In one or more embodiments, the elongated body includes a first section connected to the first joint, a second section connected to the second joint, and an adjustment section connected between the first and second section by threaded connections of different directions, wherein turning the adjustment section lengthens or shortens a distance between the first joint and the second joint.

Another embodiment provides a method of positioning a tool at a wellsite. The method includes supporting a tool on a tool adaptor at a first joint and a second joint, wherein the first joint pivotably connects the tool adaptor to an end arm in connection with a drive arm, and a second joint pivotably connects the tool adaptor to a rigid leveling link in connection with the end arm, and rotating the drive arm thereby causing the end arm to move the first joint along a first trajectory while leveling the tool using the rigid leveling link.

In one or more embodiments, the method further includes adjusting a length of the leveling link to stabilize the tool.

In one or more embodiments, rotating the drive arm causes the second joint to move along a second trajectory through a leveling arm pivotably coupled to the end arm and the rigid leveling link and a stabilizing link pivotably connected between the leveling arm and the drive arm or an intermediate arm in connection with the drive arm.

In one or more embodiments, rotating the drive arm causes the second joint to move along a second trajectory through a leveling arm pivotably coupled to the end arm and the rigid leveling link and a stabilizing cam attached to the drive arm or an intermediate arm in connection with the drive arm.

While the foregoing is directed to embodiments of the present disclosure, other and further embodiments of the disclosure may be devised without departing from the basic scope thereof, and the scope thereof is determined by the claims that follow.

The invention claimed is:

1. A positioning tool, comprising:
- a retractable arm assembly comprising:
  - a first arm;
  - a second arm, wherein a first end of the first arm is pivotably coupled to the second arm and a second end of the first arm is pivotably coupled to a tool adaptor; and
- a leveling assembly comprising:
  - a leveling arm pivotably coupled to the first arm;
  - a leveling link pivotably coupled to the tool adaptor and the leveling arm, wherein one of the leveling arm and the leveling link is connected to the second arm; and
  - a stabilizing link, wherein the leveling arm is connected to the second arm by the stabilizing link.

2. The positioning tool of claim 1, wherein the leveling link comprises an elongated rigid body connected to the tool adaptor by a first joint and connected to the leveling arm by a second joint.

3. The positioning tool of claim 2, wherein the elongated body comprises:
- a first section connected to the first joint;
- a second section connected to the second joint; and
- an adjustment section connected between the first and second section by threaded connections of different directions, wherein turning the adjustment section lengthens or shortens a distance between the first joint and the second joint.

4. The positioning tool of claim 1, wherein the stabilizing link has a first end pivotably connected to the leveling arm and a second end pivotably connected to the second arm.

5. The positioning tool of claim 1, wherein the retractable arm assembly further comprises:
- a frame member; and
- an arm actuator coupled between the frame member and the second arm, wherein the arm actuator is configured to rotate the second arm relative to the frame member, and rotation of the second arm causes the first arm and the second arm to extend or retract, thereby, moving the tool adaptor.

6. The positioning tool of claim 1, wherein the retractable arm assembly further comprises:
- a third arm pivotably coupled to the second arm;
- a frame member; and
- an arm actuator coupled between the frame member and the third arm, wherein the arm actuator is configured to rotate the third arm relative to the frame member, and rotation of the third arm causes the first arm, the second arm, and third arm to extend or retract, thereby, moving the tool adaptor.

7. The positioning tool of claim 6, wherein the retractable arm assembly further comprises:
- a first link pivotably connecting the first arm and the third arm; and
- a second link pivotably connecting the second arm and the frame member.

8. A positioning tool, comprising:
- a drive arm movably connected to a frame member;
- an end arm in connection with the drive arm, wherein the end arm is pivotably coupled to a tool adaptor, and rotation of the drive arm extends or retracts the end arm moving the tool adaptor along a trajectory;
- a leveling arm pivotably coupled to the end arm; and
- a leveling link having an elongated body pivotably connected between the tool adaptor and the leveling arm.

9. The positioning tool of claim 8, further comprising:
- an intermediate arm connected between the drive arm and the end arm, wherein one of the leveling arm and the leveling link is connected with the intermediate arm.

10. The positioning tool of claim 9, further comprising:
- a stabilizing link, wherein the stabilizing link is pivotably connected between the leveling arm and the intermediate arm.

11. The positioning tool of claim 9, further comprising:
- a stabilizing cam attached to the intermediate arm, wherein the leveling link includes a roller movable along a roller slot in the stabilizing cam.

12. The positioning tool of claim 8, wherein the drive arm and the end arm are pivotably connected by a joint, and one of the leveling arm and the leveling link is connected with the drive arm.

13. The positioning tool of claim 8, wherein the leveling link is connected to the tool adaptor by a first joint and connected to the leveling arm by a second joint.

14. The positioning tool of claim 13, wherein the elongated body comprises:
- a first section connected to the first joint;
- a second section connected to the second joint; and
- an adjustment section connected between the first and second section by threaded connections of different directions, wherein turning the adjustment section lengthens or shortens a distance between the first joint and the second joint.

15. A method of positioning a tool at a wellsite, comprising:
- supporting a tool on a tool adaptor at a first joint and a second joint, wherein the first joint pivotably connects the tool adaptor to an end arm in connection with a drive arm, and the second joint pivotably connects the tool adaptor to a rigid leveling link in connection with the end arm; and rotating the drive arm thereby causing the end arm to move the first joint along a first trajectory while leveling the tool using the rigid leveling link.

16. The method of claim 15, further comprising adjusting a length of the rigid leveling link to stabilize the tool.

17. The method of claim 15, wherein rotating the drive arm causes the second joint to move along a second trajectory through a leveling arm pivotably coupled to the end arm and the rigid leveling link and a stabilizing link pivotably connected between the leveling arm and the drive arm or an intermediate arm in connection with the drive arm.

18. The method of claim 15, wherein rotating the drive arm causes the second joint to move along a second trajectory through a leveling arm pivotably coupled to the end arm and the rigid leveling link and a stabilizing cam attached to the drive arm or an intermediate arm in connection with the drive arm.

19. A positioning tool, comprising:

a retractable arm assembly comprising:

a first arm;

a second arm, wherein a first end of the first arm is pivotably coupled to the second arm and a second end of the first arm is pivotably coupled to a tool adaptor; and a leveling assembly comprising:

a stabilizing cam attached to the second arm;

a leveling arm pivotably coupled to the first arm; and a leveling link pivotably coupled to the tool adaptor and the leveling arm, wherein the leveling link includes a roller disposed in a roller slot in the stabilizing cam, wherein one of the leveling arm and the leveling link is connected to the second arm.

20. The positioning tool of claim 19, wherein the stabilizing cam is formed on the second arm.

21. The positioning tool of claim 19, wherein the retractable arm assembly further comprises:

a third arm pivotably coupled to the second arm;

a frame member; and an arm actuator coupled between the frame member and the third arm, wherein the arm actuator is configured to rotate the third arm relative to the frame member, and rotation of the third arm causes the first arm, the second arm, and third arm to extend or retract, thereby, moving the tool adaptor.

* * * * *